US010308452B2

(12) United States Patent
Sugano

(10) Patent No.: US 10,308,452 B2
(45) Date of Patent: Jun. 4, 2019

(54) IMAGE FORMING APPARATUS

(71) Applicant: CANON KABUSHIKI KAISHA, Tokyo (JP)

(72) Inventor: Michio Sugano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/904,936

(22) Filed: Feb. 26, 2018

(65) Prior Publication Data

US 2018/0246460 A1 Aug. 30, 2018

(30) Foreign Application Priority Data

Feb. 28, 2017 (JP) ..... 2017-036825

(51) Int. Cl.
*B65H 1/26* (2006.01)
*G03G 15/00* (2006.01)
(Continued)

(52) U.S. Cl.
CPC ..... *B65H 1/266* (2013.01); *B65H 7/06* (2013.01); *B65H 7/20* (2013.01); *G03G 15/6561* (2013.01); *G03G 15/70* (2013.01); *B65H 2405/112* (2013.01); *B65H 2511/414* (2013.01); *B65H 2511/528* (2013.01); *B65H 2511/529* (2013.01);
(Continued)

(58) Field of Classification Search
CPC ..... B65H 1/266; B65H 7/00; B65H 7/02; B65H 7/04; B65H 7/06; B65H 7/08; B65H 7/10; B65H 7/12; B65H 7/14; B65H 7/20; B65H 2511/528; B65H 2601/11;
(Continued)

(56) References Cited

U.S. PATENT DOCUMENTS 5,012,281 A * 4/1991 Kusumoto ..... G03G 15/50 399/10
5,155,537 A * 10/1992 Komatsu ..... B65H 1/04 271/9.02
(Continued)

FOREIGN PATENT DOCUMENTS

JP 64-75339 A 3/1989
JP 7-187446 A 7/1995
(Continued)

*Primary Examiner* — Prasad V Gokhale
(74) *Attorney, Agent, or Firm* — Canon U.S.A., Inc. IP Division

(57) ABSTRACT

An image forming apparatus includes a stacking unit, an access detecting unit, a malfunction detecting unit, a counting unit, and a process deciding unit. The stacking unit receives, as stacked, a recording material. The access detecting unit detects an access to the stacking unit by an operator. The malfunction detecting unit detects that a conveyance malfunction of the recording material has occurred on a conveying path guiding the recording material supplied from the stacking unit. The counting unit counts, after the access detecting unit detects an access to the stacking unit by the operator in a state that the malfunction detecting unit does not detect that the conveyance malfunction has occurred, the number of the conveyance malfunction detected by the malfunction detecting unit. The process deciding unit decides a process to address the conveyance malfunction based on the number of the conveyance malfunction counted by the counting unit.

14 Claims, 7 Drawing Sheets

(51) Int. Cl.
*B65H 7/06* (2006.01)
*B65H 7/20* (2006.01)

(52) U.S. Cl.
CPC ..... *B65H 2513/53* (2013.01); *B65H 2551/20* (2013.01); *B65H 2601/11* (2013.01); *B65H 2601/255* (2013.01); *B65H 2601/271* (2013.01); *G03G 2215/00548* (2013.01)

(58) Field of Classification Search
CPC ..... B65H 2601/255; G03G 15/70; G03G 15/6561; G03G 2215/00548
See application file for complete search history.

(56) References Cited

U.S. PATENT DOCUMENTS

2005/0254842 A1* 11/2005 Morisaki ..... B65H 7/06 399/16
2009/0317096 A1* 12/2009 Odaira ..... G03G 15/6529 399/21
2010/0322689 A1* 12/2010 Ohtani ..... B65H 1/04 399/388
2013/0195474 A1* 8/2013 Miyamoto ..... G03G 15/70 399/19

FOREIGN PATENT DOCUMENTS

JP 3667020 B2 7/2005
JP 2011107342 A 6/2011

* cited by examiner

IMAGE FORMING APPARATUS

BACKGROUND OF THE INVENTION

Field of the Invention

The present disclosure relates to an image forming apparatus such as a copier and a printer.

Description of the Related Art

Stacking recording materials more than expected in design in a sheet feeding cassette or a manual feed tray of a copier or a printer, for example, or stacking recording materials displaced from a predefined position may cause a conveyance malfunction such as a conveyance delay and a sheet jam. Accordingly, an image forming apparatus has been proposed which determines the necessity for dispatch of a serviceman based on a correspondence relationship between a cumulative total number of sheet jams and the number of passed recording materials upon occurrence of sheet jams. It has been further proposed that a threshold value for determination of the necessity of the dispatch is to be adjusted in a case where the dispatch of a serviceman is actually not needed (See Japanese Patent No. 3667020, for example).

However, a conveyance malfunction due to a misoperation performed by a user may occur in a conventional image forming apparatus, instead of a conveyance malfunction due to a failure of the image forming apparatus or a damaged component. Then, even a conveyance malfunction due to a user's misoperation may involve dispatch of a serviceman, which may require unnecessary labor and costs.

SUMMARY OF THE INVENTION

The present disclosure was made in view of the above circumstance to discriminate with higher accuracy a failure of an image forming apparatus or a damaged component or a user's misoperation.

According to an aspect of the present disclosure, an image forming apparatus includes a stacking unit configured to receive, as stacked, a recording material, an access detecting unit configured to detect an access to the stacking unit by an operator, a malfunction detecting unit configured to detect that a conveyance malfunction of the recording material has occurred on a conveying path guiding the recording material supplied from the stacking unit, a counting unit configured to count, after the access detecting unit detects an access to the stacking unit by the operator in a state that the malfunction detecting unit does not detect that the conveyance malfunction has occurred, the number of the conveyance malfunction detected by the malfunction detecting unit, and a process deciding unit configured to decide a process to address the conveyance malfunction based on the number of the conveyance malfunction counted by the counting unit.

Further features of the present invention will become apparent from the following description of embodiments with reference to the attached drawings.

DESCRIPTION OF THE EMBODIMENTS

Embodiments of the present disclosure will be described below with reference to drawings.

First Embodiment

Image Forming Apparatus 1

Figure 1:
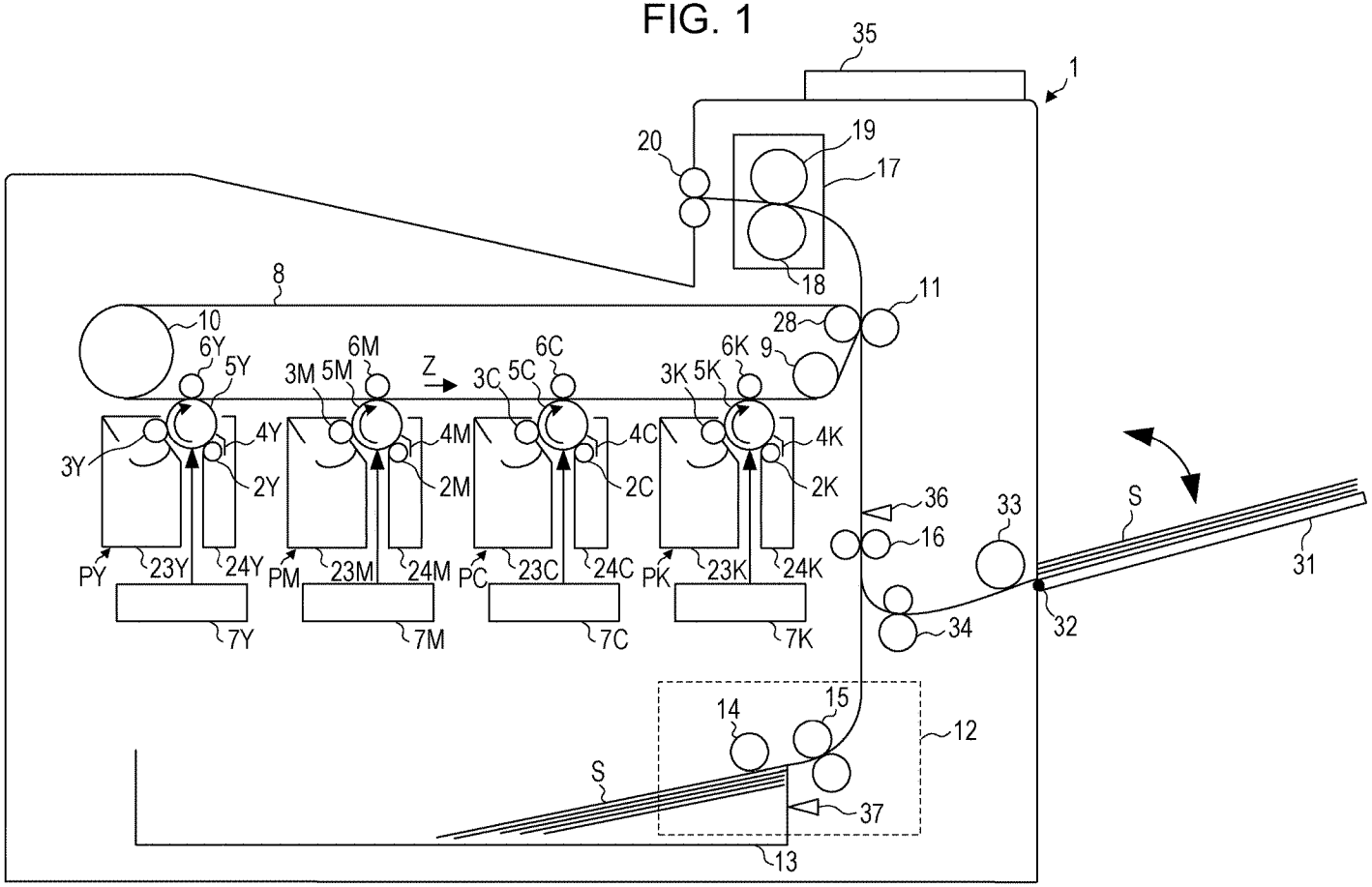
FIG. 1 is a schematic cross sectional view of an image forming apparatus according to a first embodiment.

FIG. 1 is a schematic cross sectional view illustrating an image forming apparatus according to a first embodiment. A full-color image forming apparatus including four drums having an intermediate transfer belt according to the first embodiment will be described as an image forming apparatus example among electrophotographic image forming apparatuses. A full-color image forming apparatus 1 illustrated in FIG. 1 includes detachable process cartridges PY, PM, PC, and PK. These four process cartridges PY, PM, PC, and PK have an identical structure. The process cartridges are different in that they accommodate toners of different colors, that is, yellow (Y), magenta (M), cyan (C), black (K) for image formation. Because the colors have the same configuration according to this embodiment, subscripts Y, M, C, K corresponding to colors yellow, magenta, cyan, and black, respectively, will be omitted below except as otherwise necessary.

Each of the process cartridges P has a toner container 23, a photoconductive drum 5 being an image bearing member, a charging roller 2, a development roller 3, a drum cleaning blade 4, and a residual toner container 24. Laser units 7 are disposed under the process cartridges P and are configured to expose photoconductive drums 5 based on an image signal. The photoconductive drums 5 apply voltage having a predetermined negative polarity to the charging rollers 2 so that the photoconductive drums 5 are charged to a potential having a predetermined negative polarity and that electrostatic latent images are formed on the photoconductive drums 5 because of the exposure from the laser units 7. When voltage having a predetermined negative polarity is applied to the development rollers 3, the electrostatic latent images undergo reversal development so that toner images of Y, M, C, and K are formed on the photoconductive drums 5. The toners to be used according to the first embodiment are charged to a negative polarity.

An intermediate transfer unit includes an intermediate transfer belt 8 being an intermediate transfer body, a drive roller 9, a tension roller 10, and a facing roller 28. The photoconductive drums 5 face primary transfer rollers 6 inside the intermediate transfer belt 8 to which a voltage applying unit (not illustrated) applies transfer voltage. The photoconductive drums 5 rotate clockwise in the directions indicated by the illustrated arrows, and the intermediate transfer belt 8 rotates counterclockwise in a Z direction indicated by the illustrated arrow. When voltage having a positive polarity is applied to the primary transfer rollers 6, the toner images formed on the photoconductive drums 5 are primary transferred to the intermediate transfer belt 8. Toner images are transferred to and are superimposed on the intermediate transfer belt 8 sequentially from the toner image on the photoconductive drum 5Y to the photoconductive drums 5M, 5C, and 5K. Rotation of the intermediate transfer belt 8 conveys the synthetic toner image obtained by superimposing the toner images of the four colors to the position of a secondary transfer roller 11.

A sheet feeder 12 has a feed roller 14 and a conveyance roller pair 15. The feed roller 14 is configured to feed a recording material S from inside of a sheet feeding cassette 13 being a stacking unit to a conveying path. The conveyance roller pair 15 is configured to convey a recording material S fed to the conveying path which guides the recording material S. The sheet feeding cassette 13 is insertable to the image forming apparatus 1 and is configured to contain recording materials S stacked at a predetermined position within the sheet feeding cassette 13. A recording material S supplied from the sheet feeder 12 is conveyed to the position of the secondary transfer roller 11 through a registration roller pair 16. The recording material S is not particularly limited if a toner image can be transferred and be fixed thereto and may be a sheet, for example.

A manual feed tray 31 is another example of the stacking unit holding stacked sheets. The image forming apparatus 1 may include both of the sheet feeding cassette 13 and the manual feed tray 31. The manual feed tray 31 rotates about a pivot 32 to shift between an accommodated state in which the manual feed tray 31 is accommodated in the image forming apparatus 1 and a stackable state in which recording materials S are stackable. A recording material S stacked in the manual feed tray 31 is picked up by a feed roller 33, is fed to the conveying path by the conveyance roller pair 34 and is conveyed to the position of the registration roller pair 16. The feed roller 33 and the conveyance roller pair 34 are examples of a conveying unit configured to convey a recording material S.

In order to transfer a toner image from the intermediate transfer belt 8 to the recording material S, voltage having a positive polarity is applied to the secondary transfer roller 11. Thus, the synthetic toner image on the intermediate transfer belt 8 can undergo secondary transfer on to the recording material S conveyed through the conveying path. The recording material S to which the synthetic toner image is transferred is conveyed to the fixing device 17 and is heated and pressurized by the fixing film 18 and the pressing roller 19 so that the toner image is fixed to a surface of the recording material S. The recording material S to which the toner image is fixed is discharged from inside of the image forming apparatus 1 by the discharge roller pair 20.

A display unit 35 has a display device and an input device. In a case where the image forming apparatus 1 determines that a conveyance malfunction such as a conveyance delay or a sheet jam of a recording material S has occurred, information such as text and an image indicating that a conveyance malfunction has occurred is displayed on the display unit 35 so that the conveyance malfunction can be notified to a user. The image forming apparatus 1 can display a procedure for addressing the conveyance malfunction on the display unit 35 as required. A conveying path sensor 36 being a malfunction detecting unit is placed in vicinity of the registration roller pair 16 and is also called a registration sensor 36.

The registration sensor 36 can be used for detecting a leading end and a rear end of a recording material S and for detecting a conveyance time for a recording material S and a size of a recording material Sin a conveying direction. If the size of the recording material S detected by the registration sensor 36 is different from a preset size of the recording material S, a conveyance malfunction due to a recording material size mismatch can be detected. The first embodiment assumes a sheet jam as a conveyance malfunction. However, the registration sensor 36 may detect another kind of malfunction as a conveyance malfunction. For example, sensors may be mounted at two different positions in a direction (width direction, left right direction) orthogonal to the conveying direction of a recording material S so that a malfunction (deflected sheet) in which a recording material S can be conveyed in a deflected to one side in a width direction may be detected as a conveyance malfunction. A malfunction (skew sheet) in which a skew recording material S is conveyed may be detected as a conveyance malfunction. A malfunction (conveyance delay) in which conveyance of a recording material S is apparently delayed more than normal though no sheet jam is occurring may also be detected as a conveyance malfunction. A cassette sensor 37 is configured to detect the presence or absence of the sheet feeding cassette 13.

Control Configuration

Figure 2:
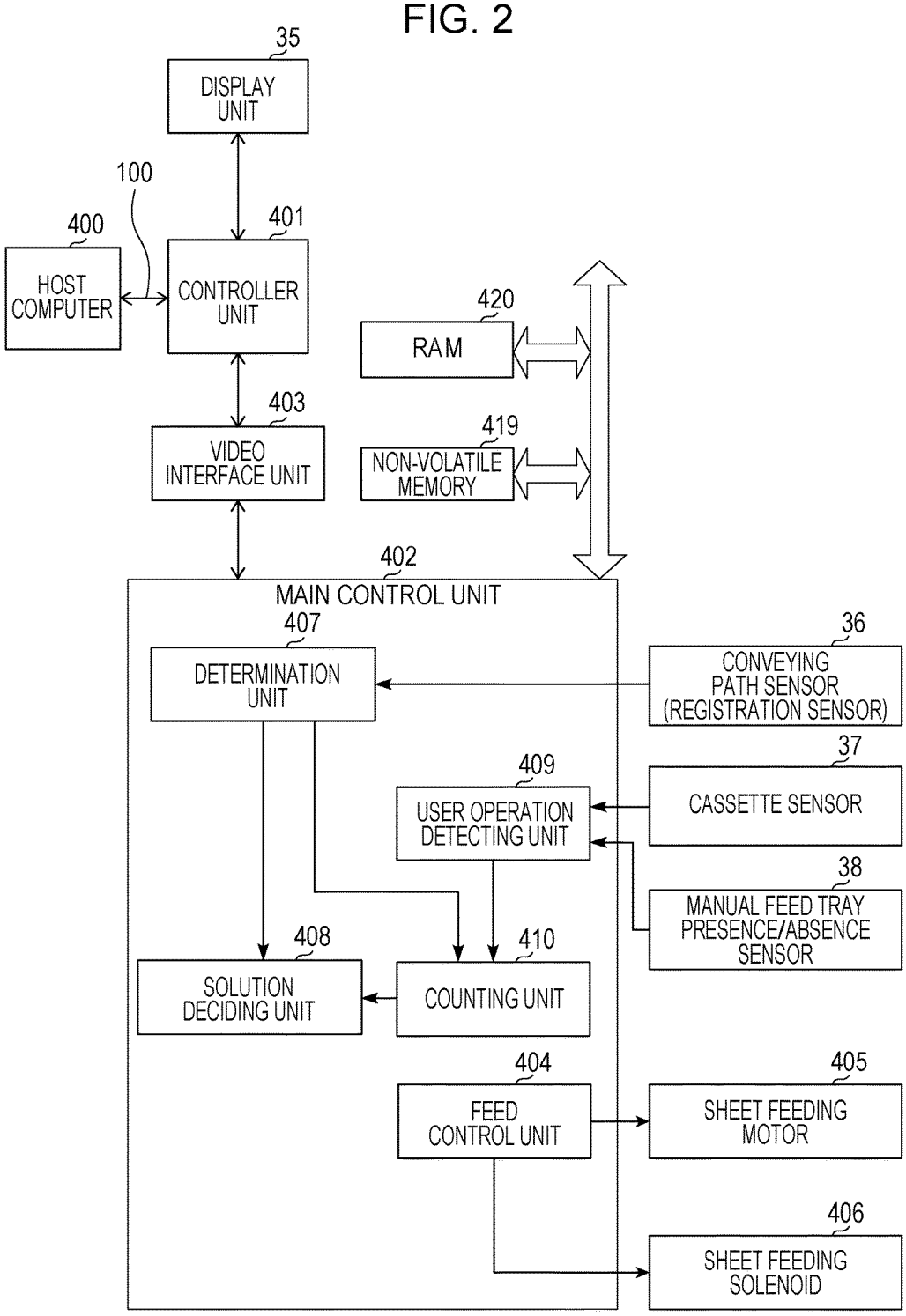
FIG. 2 is a block diagram illustrating a control configuration of the image forming apparatus according to the first embodiment.

FIG. 2 is a block diagram illustrating a control configuration of the image forming apparatus according to the first embodiment. A controller unit 401 is mutually communicable with the host computer 400 through a communication line 100 and is also mutually communicable with a main control unit 402 through a video interface unit 403. The controller unit 401 is configured to receive image information and printing conditions from the host computer 400. The controller unit 401 expands the image information received from the host computer 400 into an image and transmits it as printing information to the main control unit 402 through the video interface unit 403.

The video interface unit 403 receives a command or a signal to be exchanged between the controller unit 401 and the main control unit 402 and transmits it to the controller unit 401 or the main control unit 402. For example, the video interface unit 403 can receive a signal requesting a state of the image forming apparatus 1 or image information from the main control unit 402 and transmit it to the controller unit 401.

The controller unit 401 and the display unit 35 are mutually communicable. The controller unit 401 can set an image forming condition based on an image forming mode designated through an input device on the display unit 35 by a user (operator). The display unit 35 can display a message notifying a conveyance malfunction of a recording material S, which is detected by the main control unit 402.

In response to a print start command, the main control unit 402 outputs a /TOP signal being reference timing for outputting an image signal to the process cartridge PY so that the feed control unit 404 can start a paper feeding operation. More specifically, in order to feed a recording material S from the sheet feeding cassette 13, the feed control unit 404 drives a sheet feeding motor 405 to rotate the conveyance roller pair 15. When the feeding starts, the feed control unit 404 drives the sheet feeding motor 405 and a sheet feeding solenoid 406 to rotate the feed roller 14 once. The top one recording material S pressed upward within the sheet feeding cassette 13 is abutted against the feed roller 14. Rotation of the feed roller 14 feeds and conveys the recording materials S one by one to the conveyance roller pair 15. Each of the recording material S is conveyed to the registration sensor 36 by the conveyance roller pair 15 so that the registration sensor 36 can detect a leading end of the recording material S. Also in order to feed a recording material S from the manual feed tray 31, the feed control unit 404 drives the sheet feeding motor 405 to rotate the feed roller 33 and the conveyance roller pair 34.

A determination unit 407 is configured to measure a registration sensor arrival time T that is a time period from a time when a recording material S is fed from the sheet feeding cassette 13 or the manual feed tray 31 to a time when the leading end of the recording material S arrives at the registration sensor 36. The determination unit 407 is configured to determine whether a conveyance delay or a sheet jam of a recording material S has occurred or not based on the registration sensor arrival time T.

A user operation detecting unit 409 is configured to use the cassette sensor 37 to detect insertion or removal (or access) of the sheet feeding cassette 13 performed by a user. According to the first embodiment, a counting unit 410 is configured to the number of conveyance malfunctions (such as a conveyance delay and a sheet jam) having occurred during two insertion and removal operations performed on the sheet feeding cassette 13 by a user. The expression "two insertion and removal operations" refers to a period from a time when the user operation detecting unit 409 detects an insertion or removal of the sheet feeding cassette 13 by a user to a time when the user operation detecting unit 409 detects insertion or removal of the sheet feeding cassette 13 by the user again.

In a case where the stacking unit is the manual feed tray 31, the user operation detecting unit 409 can detect that a user has operated the manual feed tray 31 by using a manual feed tray presence/absence sensor 38, not illustrated in FIG. 1. More specifically, the manual feed tray presence/absence sensor 38 can detect the presence or absence of a recording material S on the manual feed tray 31 and the size of the recording material S. In a case where the stacking unit is the manual feed tray 31, the counting unit 410 counts the number of conveyance malfunctions occurring during a period from a time when an operation performed on the manual feed tray 31 by a user is detected to a time when an operation performed on the manual feed tray 31 by the user is detected again. More specifically, this period may correspond to a period from a time when it is detected that a recording material S is stacked on the manual feed tray 31 to a time when a user removes the recording material S from the manual feed tray 31 and then stacks a recording material S on the manual feed tray 31 again, for example.

A solution deciding unit 408, or process deciding unit 408, is configured to decide a process to address a conveyance malfunction to works towards preventing future malfunction based on the number of conveyance malfunctions counted by the counting unit 410 and a determination result by the determination unit 407. More specifically, the solution deciding unit 408 can decide a display content to be displayed on the display unit 35 based on the number of malfunctions. The solution deciding unit 408 can decide a display content to be displayed on the display unit 35 based on whether the number of conveyance malfunctions is higher than a predetermined threshold value or not. A plurality of threshold values therefor may be set, and a predetermined threshold value and another threshold value different from the predetermined threshold value may be set.

The main control unit 402 is configured to transmit information regarding the display content decided by the solution deciding unit 408 to the controller unit 401 through the video interface unit 403. The controller unit 401 transmits the information regarding the display content to the display unit 35 and causes the display unit 35 to display it. The display content on the display unit 35 may include a procedure for removing a jammed sheet, for example, in order to address a conveyance malfunction. The display content on the display unit 35 may teach a user a correct or successful position for setting a recording material S on the sheet feeding cassette 13 or the manual feed tray 31 or a correct or successful method for setting a recording material S.

If the solution deciding unit 408 decides that dispatch of a serviceman is needed as a process to address a conveyance malfunction corresponding content based on the number of conveyance malfunctions, the main control unit 402 can transmit information indicating a request for the dispatch of a serviceman to the controller unit 401. The main control unit 402 can access a RAM 420 and a non-volatile memory 419.

Figure 3A:
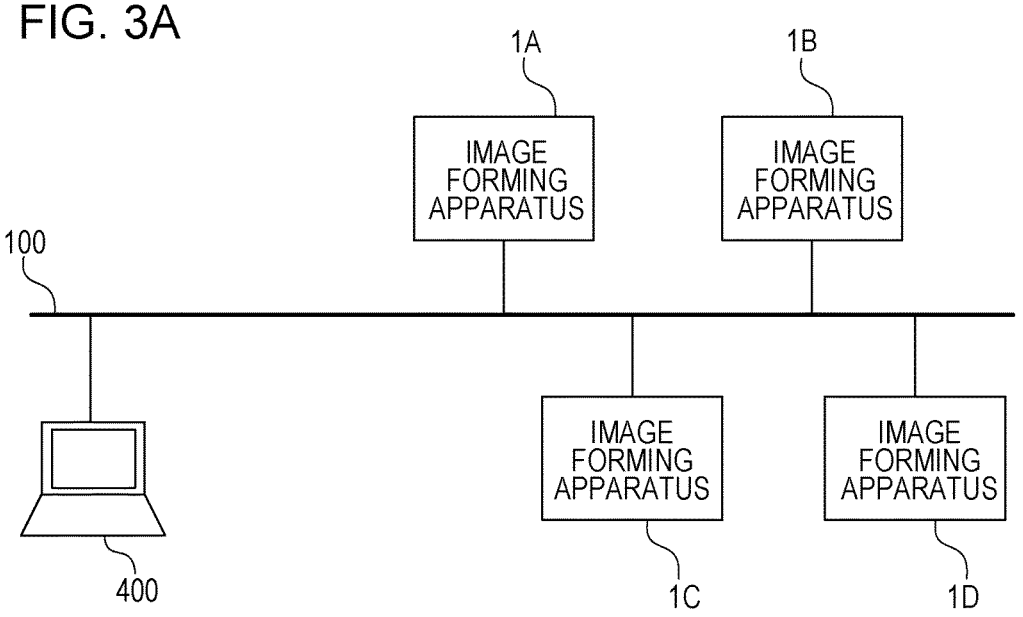
FIGS. 3A to 3D illustrate a connection configuration of image forming apparatuses and a position of a recording material within a sheet feeding cassette according to the first embodiment.

FIG. 3A illustrates a connection configuration of image forming apparatuses according to the first embodiment. The host computer 400 and a plurality of image forming apparatuses 1A, 1B, 1C, and 1D are mutually communicably connected through the communication line 100 being a communication medium. While FIG. 3A illustrates a wired communication line as the communication line 100, the communication line 100 is not limited thereto. The communication line 100 may be a wireless communication such as a near-field wireless communication over a mobile communication network or wireless LAN, for example.

The host computer 400 can monitor and manage states of all of the image forming apparatuses 1 running on the same communication line 100. The host computer 400 may be a personal computer, a server or the like if it is an information processing apparatus, without particularly limiting it. The host computer 400 and the image forming apparatus 1 can exchange data with each other through the communication line 100. When the controller unit 401 in one image forming apparatus of the image forming apparatuses 1A to 1D transmits information regarding a request for dispatch of a serviceman to the host computer 400, the host computer 400 instructs a serviceman to dispatch based on the request for the dispatch of the serviceman.

Figure 3B:
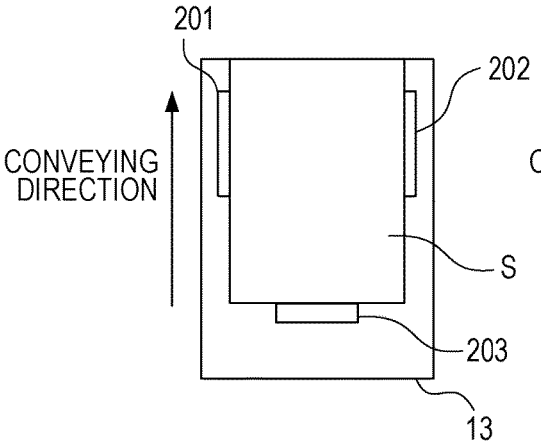
Figure 3C:
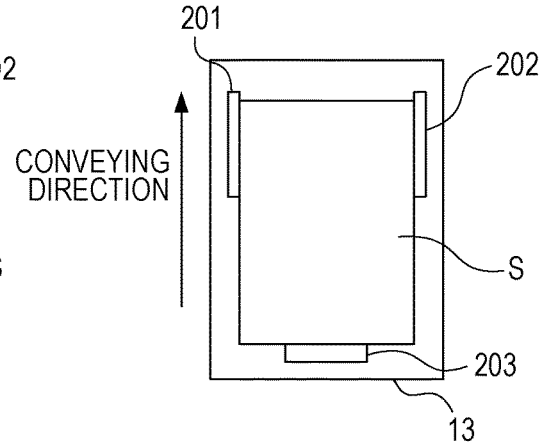
Figure 3D:
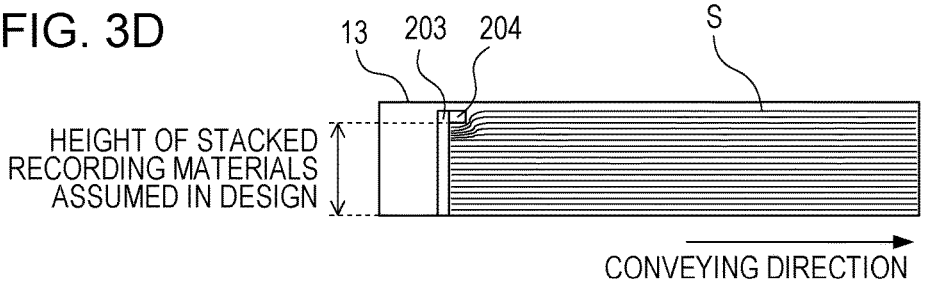

FIGS. 3B to 3D illustrate a position for setting a recording material S within a sheet feeding cassette, and with reference to FIGS. 3B to 3D, a case where improper setting of a recording material S causes a conveyance malfunction will be described. The sheet feeding cassette 13 will be described as an example, but the same configuration is also applicable to the manual feed tray 31.

Referring to FIG. 3B, within the sheet feeding cassette 13, sheet side regulating plates 201 and 202 and a sheet rear end regulating plate 203 are set at proper positions, and recording materials S are stacked at a normal position. Recording materials S the number of which is equal to or lower than an expected number in design are stacked (or the recording materials S are not over-stacked).

On the other hand, FIG. 3C illustrates a state that a recording material S is set at a wrong position. The sheet rear end regulating plate 203 is set more backward in the conveying direction than a proper position for the size of a recording material S, and the recording material S is set more backward at a feeding port than a proper position. Referring to FIG. 3C, in a case where a recording material S is set more backward in the conveying direction than the proper position, the conveyance distance needed for the leading end of the recording material S to arrive at the registration sensor 36 increases, which therefore increases the registration sensor arrival time T.

In some cases, a part of a recording material S may be positioned backward in the conveying direction to an extent that the feed roller 14 cannot pick up the recording material S. In such cases, a recording material S (hereinafter, called a "recording material Sb") stacked under the part (hereinafter, called a "recording material Sa") of the recording material S positioned backward may be picked up by the feed roller 14 to feed. In a case where the recording material Sa is stacked adjacently above the recording material Sb to be fed, when the recording material Sb is conveyed, the movement of the recording material Sb is followed by movement of the recording material Sa. However, the recording material Sa may not be nipped by the subsequent conveyance roller pair 15 and may stop in the middle of the conveying path. In this case, the recording material Sa stopping in the middle of the conveying path is conveyed by an operation for feeding the next recording material S, which may abnormally reduce the registration sensor arrival time.

Here, the range of the registration sensor arrival time T for determining that no conveyance malfunction has occurred by the determination unit 407 may be defined between Tf and Td (Tf<Td). If the registration sensor arrival time T is equal to or shorter than Tf or equal to or longer than Td, the determination unit 407 can determine that a conveyance operation or an image forming operation is not performed properly and can determine that a conveyance delay or a sheet jam, for example, may occur. Tf and Td can be determined as a minimum value and a maximum value of a range which allows image forming to be performed normally based on the conveyance speed, an abrasion state of the feed roller 14, or the type of recording material S, for example.

FIG. 3D illustrates the sheet feeding cassette 13 in which a regulating claw 204 is provided at an upper position of the sheet rear end regulating plate 203. The regulating claw 204 prevents a recording material S from running on the sheet rear end regulating plate 203. FIG. 3D illustrates a state that recording materials S the number of which is equal to or more than a number expected in design are forced to be set (or over-stacked) within the sheet feeding cassette 13. Thus, the rear end parts of the recording materials S are packed in the stacking direction (vertical direction) of the stack. Then, the rear end parts of the recording materials S are strongly pressed in the stacking direction of the stack by the regulating claw 204 and the bottom part of the sheet feeding cassette 13. The conveyance resistance acting on a conveyed recording material S becomes higher than the conveyance resistance acting on a recording material S that is not over-stacked. Particularly, in some cases, the conveyance resistance may become higher to an extent that the feed roller 14 cannot convey the recording material S. In such cases, even when a sheet feeding operation starts, the recording material S is not conveyed. Therefore, the recording material S does not arrive at the registration sensor 36 within an upper limit time Td of a normal range of the registration sensor arrival time T. In this case, the determination unit 407 determines that a conveyance malfunction has occurred and, for example, can determine that a sheet jam has occurred. A conveyance malfunction of a recording material S may occur due to improper setting of the recording material S by a user, as described above, instead of consumption or failure of a component in the image forming apparatus 1.

According to the first embodiment, whether an occurring conveyance malfunction is due to improper setting of a recording material S by a user is discriminated with higher accuracy, and whether the serviceman dispatch is needed is determined. In a case where the number of conveyance malfunctions due to improper setting of a recording material S is low, the solution deciding unit 408 can cause the display unit 35 to display information regarding a procedure for addressing the conveyance malfunctions. More specifically, the solution deciding unit 408 can cause the display unit 35 to display information regarding a procedure for removing a jammed recording material S or information regarding a predetermined position where a recording material S is to be set in the sheet feeding cassette 13 or the manual feed tray 31 (proper setting method). A user can address a conveyance malfunction by setting a recording material S at a proper setting based on the information displayed on the display unit 35. In a case where the number of conveyance malfunctions due to improper setting of a recording material S is high, it may be determined that a user does not understand a proper method for setting a recording material S, a user may not check the information displayed on the display unit 35, or a member for conveying the recording material S is failed, for example. In this case, the solution deciding unit 408 determines that the serviceman dispatch is needed. According to one form of the serviceman dispatch of the first embodiment, a telephone or an electronic mail may be used to support a user.

Processing

Figure 4:
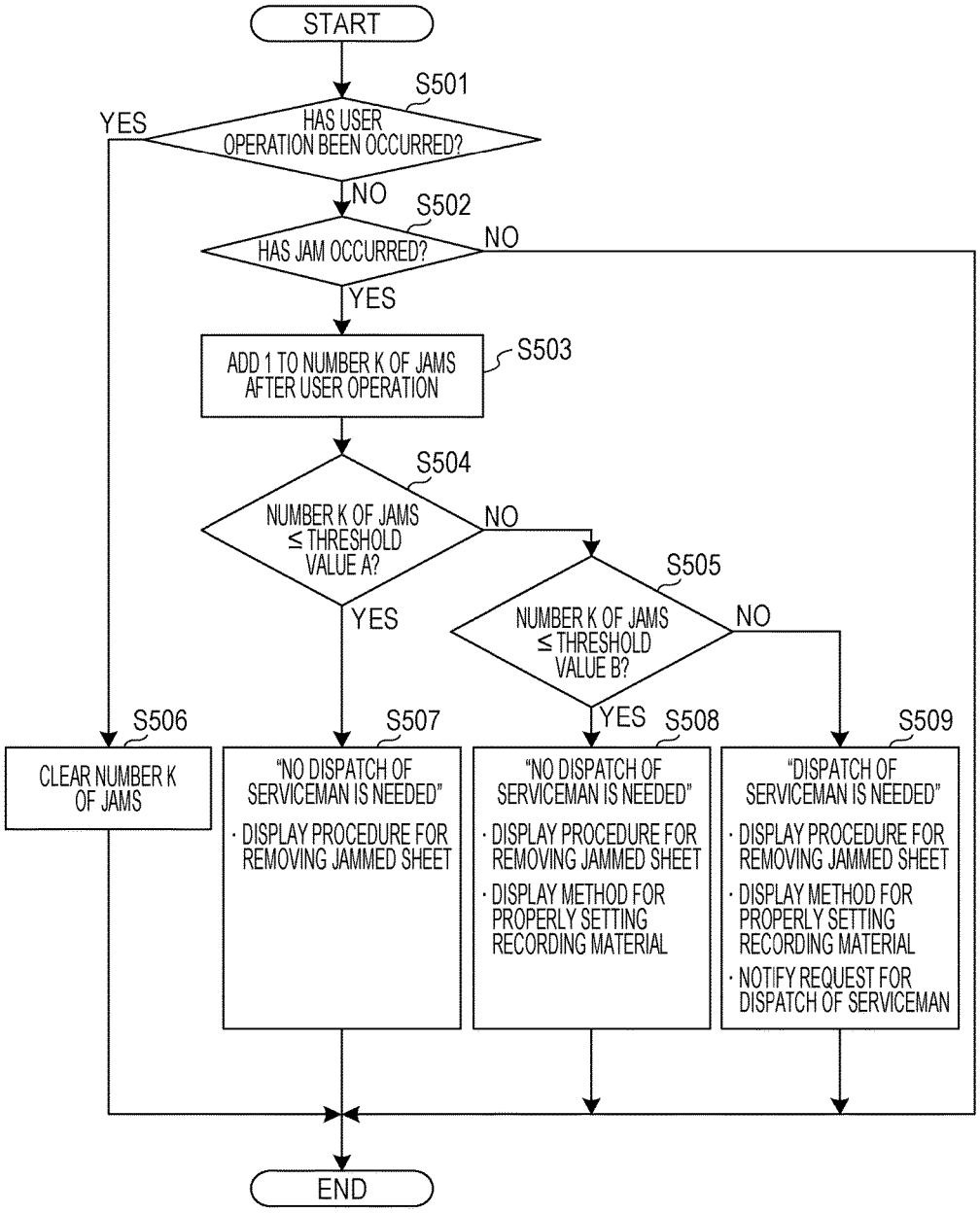
FIG. 4 is a flowchart illustrating processing to be performed in the image forming apparatus according to the first embodiment.

FIG. 4 is a flowchart illustrating processing to be performed by the image forming apparatus 1 according to the first embodiment. According to the first embodiment, a PC or a printer is assumed as the image forming apparatus 1. However, embodiments of the present disclosure are not limited thereto. The processing in the image forming apparatus 1 illustrated in FIG. 4 is to be executed predetermined cyclic intervals in all operating modes including a print operation mode. According to the first embodiment, the stacking unit may correspond to the manual feed tray 31, and a recording material S may be conveyed from the manual feed tray 31, for example. The first embodiment will be described with reference to a case where a conveyance malfunction occurs because a recording material S is jammed on the conveying path.

According to the first embodiment, the solution deciding unit 408 decides a process to work towards reducing malfunction based on whether the number K of sheet jams after a user operation (hereinafter, "the number K of sheet jams") is higher than a threshold value A or not or is higher than a threshold value B or not. According to the first embodiment, if the number K of sheet jams is higher than the threshold value A and is equal to or lower than the threshold value B, the solution deciding unit 408 can determine that a user may possibly set a recording material S at an improper position. According to the first embodiment, if the number K of sheet jams is higher than the threshold value A and the threshold value B, the solution deciding unit 408 can determine that the user may not understand a method for properly setting a recording material S or may not check the information displayed on the display unit 35. In this case, the solution deciding unit 408 can be caused to determine that the serviceman dispatch is needed.

The threshold value A and the threshold value B may be arbitrary values that are set as required and may be stored as fixed value in the non-volatile memory 419, for example. The threshold value B is higher than the threshold value A, and, according to the first embodiment, the threshold value A and the threshold value B may be set as "5" and "9", respectively, for example. The number K of sheet jams may be stored in the RAM 420.

When the processing starts based on a predetermined cycle, the main control unit 402 in step (hereinafter, "S") 501 causes the user operation detecting unit 409 to check whether a user operation has occurred or not. If the user operation detecting unit 409 determines in S501 that no user operation has occurred, the main control unit 402 advances the processing to S502.

If the user operation detecting unit 409 in S501 determines that a user operation has occurred, the main control unit 402 advances the processing to S506. If, in S501, the user operation detecting unit 409 detects that no recording material S is present in the manual feed tray 31 or that the size of the recording material S set in the manual feed tray 31 is changed, the main control unit 402 determines that a user operation has occurred. In S506, the main control unit 402 clears the value of the number K of sheet jams, that is, changes the value of the number K of sheet jams to 0 (zero). Then, the processing ends.

In S502, the main control unit 402 causes the determination unit 407 to determine whether a sheet jam of a recording material S has occurred or not. If, in S502, the determination unit 407 determines that a sheet jam has occurred, the main control unit 402 advances the processing to S503. If, in S502, the determination unit 407 determines that no sheet jam has occurred, the main control unit 402 ends the processing. In S503, the main control unit 402 causes the counting unit 410 to add (increment by) 1 to the number K of sheet jams.

In S504, the main control unit 402 causes the solution deciding unit 408 to determine whether the number K of sheet jams is equal to or lower than the threshold value A or not. If, in S504, the solution deciding unit 408 determines that the number K of sheet jams is equal to or lower than the threshold value A, the main control unit 402 advances the processing to S507. In S507, the main control unit 402 causes the display unit 35 to display that a sheet jam has occurred and a procedure for removing a jammed sheet. The processing then ends. The jammed sheet can be removed by a user by opening a door (not illustrated) provided in the image forming apparatus 1, for example.

If, in S504, the solution deciding unit 408 determines that the number K of sheet jams is higher than the threshold value A, the main control unit 402 advances the processing to S505. In S505, the main control unit 402 determines whether the number K of sheet jams is equal to or lower than the threshold value B or not. If, in S505, the solution deciding unit 408 determines that the number K of sheet jams is equal to or lower than the threshold value B, the main control unit 402 advances the processing to S508. In S508, the main control unit 402 causes the display unit 35 to display that a sheet jam has occurred and a warning that a recording material S is set at an improper position. In S508, the main control unit 402 causes the display unit 35 to display a procedure for removing a jammed sheet and display a method for properly setting a recording material S. Then, the processing ends.

If, in S505, the solution deciding unit 408 determines that the number K of sheet jams is higher than the threshold value B, the main control unit 402 advances the processing to S509. In S509, the main control unit 402 transmits the information regarding a request for serviceman dispatch to the controller unit 401. The main control unit 402 causes the display unit 35 to display a procedure for removing a jammed sheet, a method for properly setting a recording material S, and a notification that a serviceman dispatch has been requested. Then, the processing ends.

Having described the processing to be performed in a case where the stacking unit is the manual feed tray 31 according to the first embodiment and the following embodiments, the same is true in a case where the stacking unit is the sheet feeding cassette 13. In this case, the user operation corresponds to an insertion/removal of the sheet feeding cassette 13. However, in a case where the sheet feeding cassette 13 is removed to remove a jammed sheet, the determination unit 407 does not determine in S501 that a user operation has occurred, and the main control unit 402 does not perform the processing for clearing the number K of sheet jams as in S506.

Whether the sheet feeding cassette 13 is removed to remove a jammed sheet or not is determined by the determination unit 407 based on the occurrence of a sheet jam when the sheet feeding cassette 13 is removed. In other words, if the sheet feeding cassette 13 is moved and inserted when a sheet jam occurs, the determination unit 407 determines that the sheet feeding cassette 13 is removed and inserted to remove a jammed sheet. If the sheet feeding cassette 13 is removed and inserted when no sheet jam occurs on the other hand, the determination unit 407 determines that the sheet feeding cassette 13 is not removed and inserted to remove a jammed sheet.

The image forming apparatus 1 according to the first embodiment can determine a process to work towards reducing malfunction based on the number K of sheet jams as required to discriminate with higher accuracy a failure of the image forming apparatus 1 or a damaged component or a user's misoperation. The image forming apparatus 1 according to the first embodiment can compare the number K of sheet jams and an appropriate threshold value to discriminate a cause of a conveyance malfunction with higher accuracy so that an instruction including a process to work towards reducing malfunction based on the cause can be displayed to a user. The necessity for serviceman dispatch can appropriately be determined to reduce unnecessary serviceman dispatches.

Second Embodiment

Next, a second embodiment will be described. Like numbers refer to like parts in the first and second embodiments, and any repetitive descriptions will be omitted. Because the second embodiment has the same fundamental configuration as that of the first embodiment, any repetitive detail descriptions will be omitted. Differences from the first embodiment will mainly be described below.

Figure 5A:
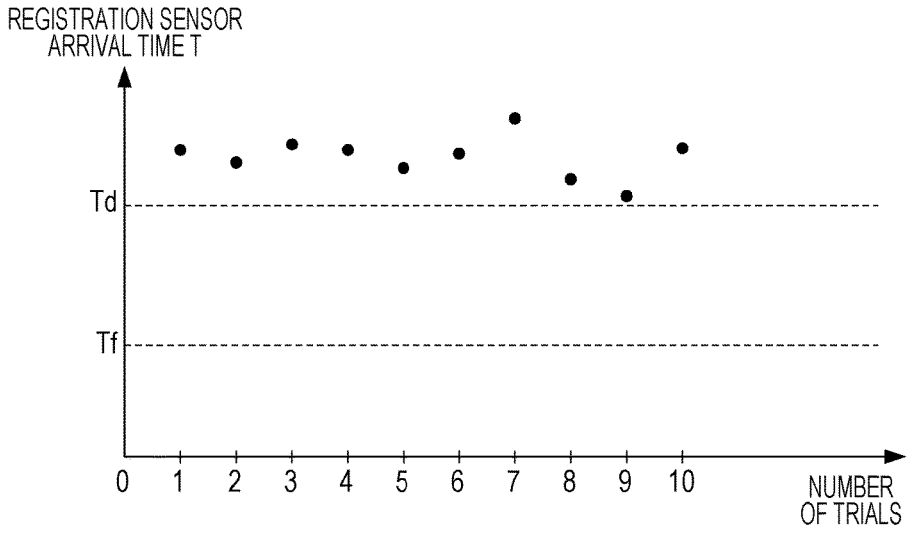
FIGS. 5A and 5B are graphs illustrating registration sensor arrival time of a recording material in a case where the recording material is set at a wrong position according to a second embodiment.
Figure 5B:
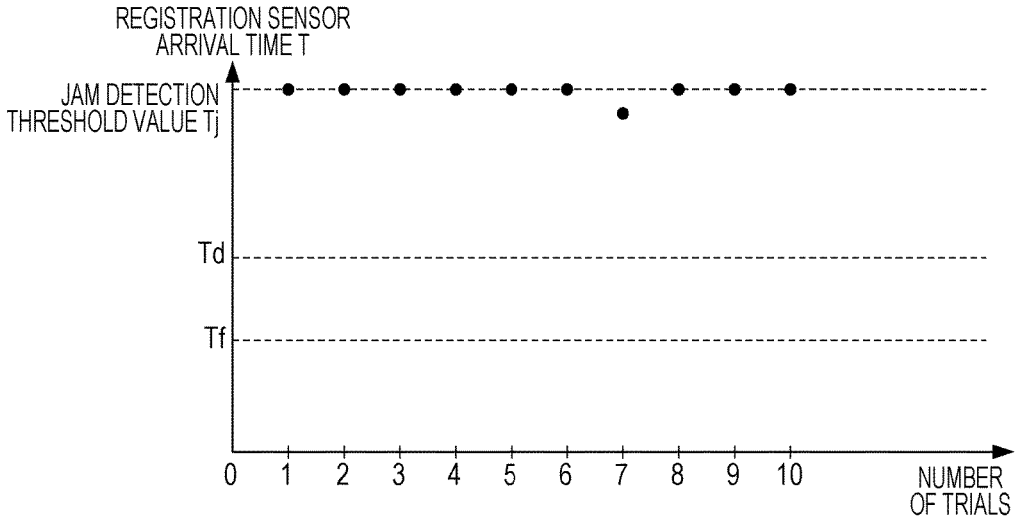

A control to be performed in the image forming apparatus 1 according to the second embodiment will be described which can determine improper setting of a recording material S by a user with higher accuracy. In a case where a recording material S is set at an improper position, there is a high possibility that a conveyance malfunction occurs during conveyance of the first recording material S immediately after the sheet feeding cassette 13 is accommodated in the image forming apparatus 1 (hereinafter, called "immediately after the sheet feeding cassette is closed"). FIGS. 5A and 5B are graphs illustrating recording material registration sensor arrival time in a case where a recording material is set at an improper position.

FIG. 5A illustrates results of measurement of a registration sensor arrival time T of the first recording material S in a case where the recording material S is set more backward in the conveying direction than the proper position setting as illustrated in FIG. 3C. FIG. 5A illustrates a vertical axis indicating registration sensor arrival time T and a horizontal axis indicating the number of trials. Because, in all of ten trials, the registration sensor arrival time T exceeds the upper limit time Td under which a normal operation can be performed, the determination unit 407 can discriminate a conveyance malfunction.

FIG. 5B illustrates results of measurement of the registration sensor arrival time T of the first recording material S in a case where recording materials S the number of which is equal to or higher than the number expected in design are set within the sheet feeding cassette 13, as illustrated in FIG. 3D. In this case, the recording materials S are stacked with partial materials of the recording materials S forced to be set under the regulating claw 204.

FIG. 5B illustrates a vertical axis indicating registration sensor arrival time T and a horizontal axis indicating the number of trials. In nine trials of a total of ten trials, no recording material S is conveyed and does not reach the registration sensor 36. Therefore, occurrence of a sheet jam can be determined. In one (the seventh trial) of the ten trials, a conveyance delay which is discriminated as a conveyance malfunction can be determined though it is not determined as a sheet jam. When the recording material S does not arrive at the registration sensor 36, the registration sensor arrival time T is unmeasurable. Therefore, it is plotted at a value equal to a sheet jam detection threshold value Tj in FIG. 5B for convenience. Here, the sheet jam detection threshold value Tj is a threshold value for determines occurrence of a sheet jam based on the length of the registration sensor arrival time T. If the registration sensor arrival time T exceeds the sheet jam detection threshold value Tj, occurrence of a sheet jam is determined. According to the second embodiment, immediately after the sheet feeding cassette is closed, a failure of the image forming apparatus 1 or a damaged component or a user's misoperation can be discriminated based on the number of conveyance malfunctions with the first recording material S.

Figure 6:
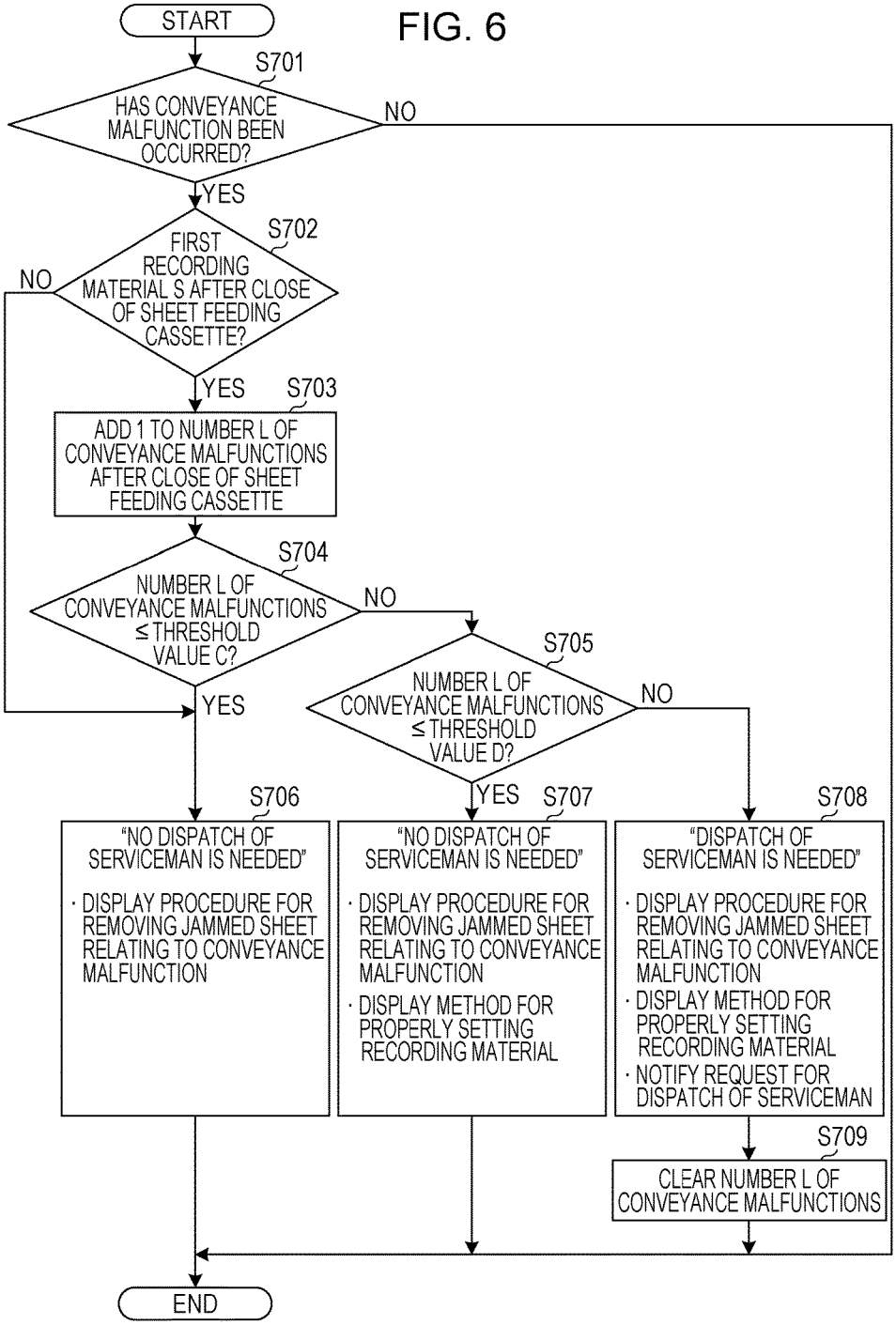
FIG. 6 is a flowchart illustrating processing to be performed in the image forming apparatus according to the second embodiment.

FIG. 6 is a flowchart illustrating processing to be performed by the image forming apparatus 1 according to the second embodiment. The processing in the image forming apparatus 1 illustrated in FIG. 6 is to be executed predetermined cyclic intervals in all operating modes including a print operation mode. According to the second embodiment, the solution deciding unit 408 determines a process to work towards reducing malfunction based on whether the number L of conveyance malfunctions immediately after the sheet feeding cassette is closed is higher than a threshold value C or not or is higher than a threshold value D or not. According to the second embodiment, the term "conveyance malfunction" refers to a case where the registration sensor arrival time T is out of a normal operation range (Tf to Td) or a case where a sheet jam occurs.

According to the second embodiment, if the number L of conveyance malfunctions is higher than the threshold value C and is equal to or lower than the threshold value D, the solution deciding unit 408 can determine that there is a possibility that a recording material S is set at an improper position by a user. According to the second embodiment, if the number L of conveyance malfunctions is higher than the threshold value C and the threshold value D, the solution deciding unit 408 can determine that the user may not understand a method for properly setting a recording material S or may not check the information displayed on the display unit 35. In this case, the solution deciding unit 408 can be caused to determine that the serviceman dispatch is needed.

The threshold value C and the threshold value D may be arbitrary values that are set as required and may be stored as fixed value in the non-volatile memory 419, for example. The threshold value C and the threshold value D may be held in the RAM 420 as an internal variable to be adjusted based on an external factor such as the number of conveyance malfunctions. The threshold value D is higher than the threshold value C, and, according to the second embodiment, the threshold value C and the threshold value D may be set as "5" and "9", respectively, for example. The number L of conveyance malfunctions may be stored in the RAM 420.

When the processing starts based on a predetermined cycle, the main control unit 402 in S701 causes the determination unit 407 to determine whether a conveyance malfunction has occurred or not. If the determination unit 407 in S701 determines that the conveyance malfunction has not occurred, the main control unit 402 *c* ends the processing. If the determination unit 407 in S701 determines that a conveyance malfunction has occurred, the main control unit 402 advances the processing to S702. If the main control unit 402 in S702 determines that the occurring conveyance malfunction is not related to the first recording material S immediately after the sheet feeding cassette is closed, it can be determined that there is a low possibility that improper setting of a recording material S is performed by a user. Then, the main control unit 402 advances the processing to S706. If the main control unit 402 in S702 determines that the occurring conveyance malfunction is related to the first recording material S immediately after the sheet feeding cassette is closed, the main control unit 402 advances the processing to S703.

In S703, 1 is added (or incremented) to the number L of conveyance malfunctions (hereinafter, called "the number L of conveyance malfunctions") upon conveyance of the first recording material S immediately after the sheet feeding cassette is closed. In S704, the main control unit 402 causes the solution deciding unit 408 to determine whether the number L of conveyance malfunctions is equal to or lower than the threshold value C. If the solution deciding unit 408 in S704 determines that the number L of conveyance malfunctions is equal to or lower than the threshold value C, the main control unit 402 advances the processing to S706. In S706, the main control unit 402 causes the display unit 35 to display that a conveyance malfunction has occurred and to display a procedure for removing the recording material S of the conveyance malfunction.

If the solution deciding unit 408 in S704 determines that the number L of conveyance malfunctions is higher than the threshold value C, the main control unit 402 advances the processing to S705. The main control unit 402 in S705 causes the solution deciding unit 408 to determine whether the number L of conveyance malfunctions is equal to or lower than the threshold value D or not. If the solution deciding unit 408 determines that the number L of conveyance malfunctions is equal to or lower than the threshold value D, the main control unit 402 advances the processing to S707. In S707, the main control unit 402 can determine that there is a possibility that a recording material S is set at an improper position and can cause the display unit 35 to display a warning against occurrence of a conveyance malfunction and a notification that the recording material S is set at an improper position. The main control unit 402 can also display a method for properly setting a recording material S in addition to the display of a procedure for removing the recording material S of the conveyance malfunction.

If the solution deciding unit 408 in S705 determines that the number L of conveyance malfunctions is higher than the threshold value D, the main control unit 402 advances the processing to S708. In S708, the main control unit 402 transmits information regarding a request for serviceman dispatch to the controller unit 401. The main control unit 402 causes the display unit 35 to display a procedure for removing a jammed sheet, a method for properly setting a recording material S, and a notification that a serviceman dispatch has been requested. Then, the processing moves to S709. In S709, the main control unit 402 clears the value of the number L of conveyance malfunctions to 0 (zero). When a serviceman is dispatched, the serviceman may instruct to clear the number L of conveyance malfunctions through the display unit 35. The determinations in S704 and S705 may apply the number of conveyance malfunctions (incidence of conveyance malfunctions) within a predetermined period instead of the number L of conveyance malfunctions. The incidence of conveyance malfunctions may be the number of conveyance malfunctions within a predetermined elapsed time or the number of conveyance malfunctions within a predetermined number of printed materials, for example.

The image forming apparatus 1 according to the second embodiment can determine a process to work towards reducing malfunction as required based on the number L of conveyance malfunctions of the first recording material S immediately after the sheet feeding cassette is closed or the incidence of conveyance malfunctions. Thus, a failure of the image forming apparatus 1 or a damaged component or a user's misoperation can be discriminated with higher accuracy. The image forming apparatus 1 according to the second embodiment compares the number L of conveyance malfunctions with an appropriate threshold value so that the accuracy of discrimination of improper setting of a recording material S by a user can be increased and that an instruction for a process to work towards reducing malfunction based on a situation of the user can be displayed on the display unit 35. The necessity for serviceman dispatch can appropriately be determined.

Third Embodiment

Next, a third embodiment will be described. Like numbers refer to like parts in the first and third embodiments, and any repetitive descriptions will be omitted. Because the third embodiment has the same fundamental configuration as that of the first embodiment, any repetitive detail descriptions will be omitted. Differences from the first embodiment will mainly be described below.

A control to be performed in the image forming apparatus 1 according to the third embodiment will be described which can determine a skill level of a user based on a period (or installed period) of use of the image forming apparatus 1 (corresponding to a printer below) and cause the display unit 35 to display an optimum process to address a conveyance malfunction for each user. More specifically, the threshold value A and the threshold value B that are fixed values according to the first embodiment are variables based on a skill level of a user according to the third embodiment. The third embodiment regards a skill level of a user as an installed period of the printer.

As illustrated in Table 1, the threshold value A and the threshold value B based on an installed period of the printer can be stored in the non-volatile memory 419.

TABLE 1

| Printer Installed Period M [Month] | Threshold Value A | Threshold Value B |
|---|---|---|
| 0 < M ≤ 1 | 1 | 3 |
| 1 < M ≤ 3 | 3 | 6 |
| 3 < M ≤ 6 | 5 | 9 |
| 6 < M ≤ 12 | 7 | 12 |
| 12 < M | 9 | 15 |

Table 1 has, from the left side, a first column providing a printer installed period M [month], a second column providing a threshold value A for the number K of sheet jams, and a third column providing a threshold value B for the number K of sheet jams. For example, in a case where the printer installed period is longer than 0 months and equal to or shorter than one month, the threshold value A is 1 and the threshold value B is 3. In a case where the printer installed period is longer than one month and equal to or shorter than three months, the threshold value A is 3, and the threshold value B is 6. As the printer installed period M increases, the threshold value A and threshold value B to be set increase.

The threshold value A and the threshold value B may be calculated by using a printer installed period as in Expression (1) and Expression (2) below. If a printer installed period is short, the skill level is considered as being low. In this case, the threshold value A and the threshold value B may be set lower. A skill level of a user may be determined based on a total number of materials printed by the image forming apparatus 1, without limiting to the installed period of the image forming apparatus 1.

$$\text{Threshold value } A = 2 \times M - 1 \quad (1)$$

$$\text{Threshold value } B = 3 \times M \quad (2)$$

On the other hand, if the number K of sheet jams tends to increase, it may be determined that there is a high possibility that a recording material S may be set at an improper position because a user is unfamiliar with operations of the printer. Accordingly, a value K0 before last of the number K of sheet jams and the last value K1 during a period from a time when the sheet feeding cassette 13 is closed to a time when the sheet feeding cassette 13 is opened next may be stored in the non-volatile memory 419 so that the values K0 and K1 can be compared. Thus, if the number K of sheet jams increases (K0≤K1), processing can be executed for causing the display unit 35 to display a method for properly setting a recording material S or to instruct serviceman dispatch. Here, the value K0 before last of the number K of sheet jams corresponds to the number of sheet jams occurring during a period from a time when it is detected that a user has operated the stacking unit three times ago to a time when it is detected that the user has operated the stacking unit two times ago. The last number K of sheet jams 1 corresponds to the number of sheet jams occurring during a period from a time when it is detected that a user has operated the stacking unit two times ago to a time when it is detected that the user has operated the stacking unit last time.

Figure 7:
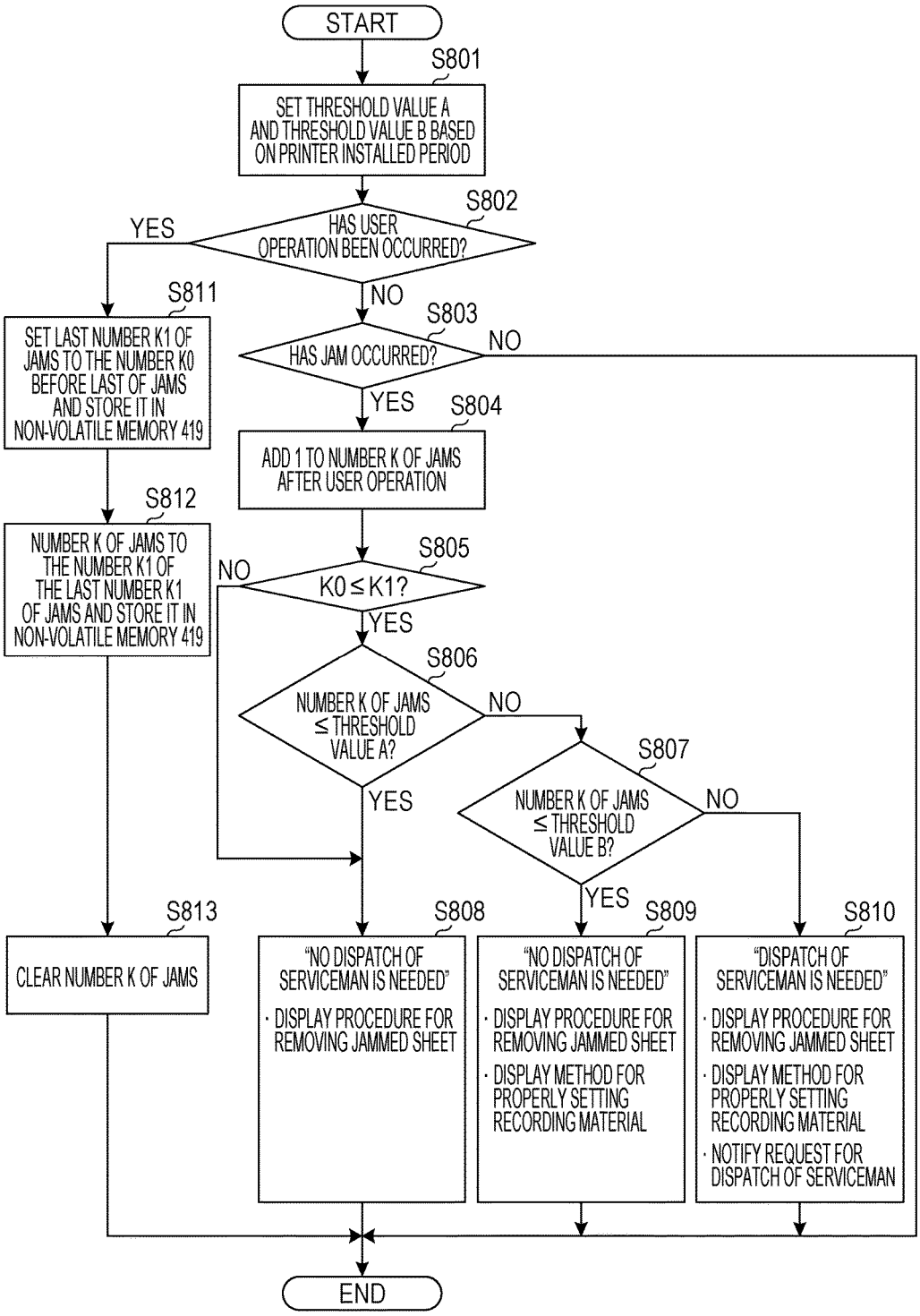
FIG. 7 is a flowchart illustrating processing to be performed in an image forming apparatus according to a third embodiment.

FIG. 7 is a flowchart illustrating processing to be performed by the image forming apparatus according to the third embodiment. The control flow according to the third embodiment is to be executed at time intervals equal to those of the first embodiment. The processing in S802 to S804, S806 to S810, and S813 according to the third embodiment is the same as the processing in S501 to S505, S507 to S509, and S506 according to the first embodiment. Therefore, any repetitive descriptions on the processing will be omitted.

When the processing starts based on a predetermined cycle, the main control unit 402 in S801 sets the threshold value A and the threshold value B based on a given printer installed period. More specifically, they can be set based on Table 1 above or Expressions (1) and (2), for example. After that, the main control unit 402 advances the processing to S802.

After 1 is added to the number K of sheet jams after a user operation in S804, the main control unit 402 in S805 compares the value K0 before last of the number K of sheet jams and the last value K1 stored in the non-volatile memory 419. The numbers K0 and K1 of sheet jams are both initialized with 0 (zero) when the printer is initially installed. If the main control unit 402 in S805 determines that K0 is equal to or lower than K1, the main control unit 402 advances the processing to S806. If the main control unit 402 in S805 determines that K0 is higher than K1, the number of sheet jams tends to decrease. Therefore it can be determined that the serviceman dispatch is not needed, and the main control unit 402 advances the processing to S808.

If the user operation detecting unit 409 in S802 determines that a user operation has occurred, the main control unit 402 advances the processing to S811. In S811, the main control unit 402 sets the last value K1 to the value K0 before last of the number K of sheet jams and stores the set last value K1 in the non-volatile memory 419. Then, the main control unit 402 advances the processing to S812. In S812, the main control unit 402 sets the number K of sheet jams to the last value K1 and stores the set number K of sheet jams in the non-volatile memory 419. Then, the main control unit 402 advances the processing to S813.

The image forming apparatus 1 according to the third embodiment can determine a skill level of a user based on printer usage information to discriminate with higher accuracy a failure of the image forming apparatus 1 or a damaged component or a user's misoperation. The image forming apparatus 1 according to the third embodiment can further notify an optimum process to address a conveyance malfunction so that an instruction for a process to work towards reducing malfunction based on a situation of the user can be displayed to the user. The necessity of the serviceman dispatch can appropriate be determined so that unnecessary serviceman dispatches can be reduced.

Having described the embodiments of the present disclosure mainly with reference to a color laser printer, for example, the present disclosure is applicable to a monochrome laser printer without limiting to a color laser printer. Embodiments of the present disclosure are applicable to image forming apparatuses, such as an ink-jet printer, other than a laser printer, without limiting to a laser printer. The present disclosure is also applicable to an image forming apparatus including a double-sided printing mechanism.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2017-036825 filed Feb. 28, 2017, which is hereby incorporated by reference herein in its entirety.

What is claimed is:

1. An image forming apparatus comprising:

a stacking unit on which a recording material is to be stacked, wherein the stacking unit is configured to be removably inserted to a main body of the image forming apparatus;

an access detecting unit configured to detect insertion of the stacking unit to the main body or removal of the stacking unit from the main body;

a malfunction detecting unit configured to detect that a conveyance malfunction of the recording material has occurred on a conveying path guiding the recording material supplied from the stacking unit;

a counting unit configured to count, after the access detecting unit detects the removal of the stacking unit and subsequently detects the insertion of the stacking unit in a state that the malfunction detecting unit does not detect that the conveyance malfunction has occurred, the number of the conveyance malfunction detected by the malfunction detecting unit; and a process deciding unit configured to decide a process to solve the conveyance malfunction based on the number of the conveyance malfunction counted by the counting unit.

2. The image forming apparatus according to claim 1, further comprising a display unit configured to display information, wherein, in a case where the number of conveyance malfunction is not higher than a first threshold value, the process deciding unit causes the display unit to display information regarding a procedure for solving the conveyance malfunction.

3. The image forming apparatus according to claim 2, wherein, in a case where the number of conveyance malfunction is higher than the first threshold value, the process deciding unit causes the display unit to display information regarding a predetermined position for setting the recording material within the stacking unit.

4. The image forming apparatus according to claim 3, further comprising a communication unit configured to communicate with an information processing apparatus through a communication medium, wherein, in a case where the number of conveyance malfunction is higher than a second threshold value, the process deciding unit transmits information requesting a serviceman dispatch to the information processing apparatus through the communication unit, and wherein the second threshold value is higher than the first threshold value.

5. The image forming apparatus according to claim 4, wherein the second threshold value is a value set to be increased as a usage period of the image forming apparatus increases.

6. The image forming apparatus according to claim 2, wherein the first threshold value is a value set to be increased as a usage period of the image forming apparatus increases.

7. The image forming apparatus according to claim 1, wherein the counting unit counts the number of conveyance malfunction in a case where the conveyance malfunction occurs with a first conveyed recording material after the access detecting unit detects the removal of the stacking unit and subsequently detects the insertion of the stacking unit in a state that the malfunction detecting unit does not detect that the conveyance malfunction has occurred.

8. The image forming apparatus according to claim 1, wherein the counting unit counts the number of conveyance malfunction during a first detection period and a second detection period subsequent to the first detection period and, in a case where the number of conveyance malfunction counted by the counting unit during the second detection period is higher than the number of conveyance malfunction counted by the counting unit during the first detection period, the process deciding unit decides the process to solve the conveyance malfunction based on the number of conveyance malfunction counted by the counting unit, and wherein each of the first and second detection periods is a detection period from a time when the access detecting unit detects the removal of the stacking unit and subsequently detects the insertion of the stacking unit in a state that the malfunction detecting unit does not detect that the conveyance malfunction has occurred to a time when the access detecting unit detects the removal of the stacking unit and subsequently detects the insertion of the stacking unit next in a state that the malfunction detecting unit does not detect that the conveyance malfunction has occurred.

9. An image forming apparatus comprising:

a stacking unit on which a recording material is to be stacked, wherein the stacking unit is configured to be removably inserted to a main body of the image forming apparatus;

an access detecting unit configured to detect insertion of the stacking unit to the main body or removal of the stacking unit from the main body;

a malfunction detecting unit configured to detect that a conveyance malfunction of the recording material has occurred on a conveying path guiding the recording material supplied from the stacking unit;

a counting unit configured to count, after the access detecting unit detects the removal of the stacking unit and subsequently detects the insertion of the stacking unit in a state that the malfunction detecting unit does not detect that the conveyance malfunction has occurred, the number of the conveyance malfunction detected by the malfunction detecting unit; and a display unit configured to display information, wherein a display content to be displayed on the display unit is changed based on the number of the conveyance malfunction counted by the counting unit.

10. The image forming apparatus according to claim 9, wherein, in a case where the number of conveyance malfunction is not higher than a threshold value, the display content is information regarding a procedure for solving the conveyance malfunction.

11. The image forming apparatus according to claim 10, wherein, in a case where the number of conveyance malfunction is higher than the threshold value, the display content is information regarding a predetermined position for setting the recording material within the stacking unit.

12. The image forming apparatus according to claim 10, wherein the threshold value is a value set to be increased as a usage period of the image forming apparatus increases.

13. The image forming apparatus according to claim 9, wherein the counting unit counts the number of conveyance malfunction in a case where the conveyance malfunction occurs with a first conveyed recording material after the access detecting unit detects the removal of the stacking unit and subsequently detects the insertion of the stacking unit in a state that the malfunction detecting unit does not detect that the conveyance malfunction has occurred.

14. The image forming apparatus according to claim 9, wherein the counting unit counts the number of conveyance malfunction during a first detection period and a second detection period subsequent to the first detection period and, in a case where the number of conveyance malfunction counted by the counting unit during the second detection period is higher than the number of conveyance malfunction counted by the counting unit during the first detection period, the display content is changed based on the number of conveyance malfunction counted by the counting unit, and wherein each of the first and second detection periods is a detection period from a time when the access detecting unit detects the removal of the stacking unit and subsequently detects the insertion of the stacking unit in a state that the malfunction detecting unit does not detect that the conveyance malfunction has occurred to a time when the access detecting unit detects the removal of the stacking unit and subsequently detects the insertion of the stacking unit next in a state that the malfunction detecting unit does not detect that the conveyance malfunction has occurred.

* * * * *